US006076536A

United States Patent [19]

Ludwig et al.

[11] Patent Number: 6,076,536

[45] Date of Patent: Jun. 20, 2000

[54] CLEANING AND PASSIVATING WATER DISTRIBUTION SYSTEMS

[75] Inventors: Jerome H. Ludwig, Sun City West; Myron B. Shenkiryk, Phoenix, both of Ariz.

[73] Assignee: H.E.R.C. Products Incorporated, Phoenix, Ariz.

[21] Appl. No.: 09/167,360

[22] Filed: Oct. 7, 1998

[51] Int. Cl.[7] ..... B08B 9/02

[52] U.S. Cl. ..... 134/22.11; 134/22.12; 134/22.14

[58] Field of Search ..... 134/22.11, 22.12, 134/22.14, 22.18, 27

[56] References Cited

U.S. PATENT DOCUMENTS

| | | | |
|---|---|---|---|
| 1,194,542 | 8/1916 | Raymond . | |
| 1,892,093 | 12/1932 | Battistella . | |
| 3,095,379 | 6/1963 | Schwartz | 252/101 |
| 3,169,545 | 2/1965 | Kolling | 137/209 |
| 3,281,268 | 10/1966 | Martin | 134/10 |
| 3,424,688 | 1/1969 | Boiko et al. | 252/87 |
| 3,522,093 | 7/1970 | Woolman | 134/27 |
| 3,527,609 | 9/1970 | Vinso | 134/3 |
| 3,667,487 | 6/1972 | Schoenbeck et al. | 134/108 |
| 3,969,255 | 7/1976 | Connelly, Jr. | 252/87 |
| 4,025,359 | 5/1977 | Connelly, Jr. | 134/3 |
| 4,032,460 | 6/1977 | Zilch et al. | 252/8.55 B |
| 4,220,550 | 9/1980 | Frenier et al. | 252/180 |
| 4,276,185 | 6/1981 | Martin | 252/87 |
| 4,541,945 | 9/1985 | Anderson et al. | 252/149 |
| 4,780,150 | 10/1988 | Anderson et al. | 134/3 |
| 4,789,406 | 12/1988 | Holder et al. | 134/3 |
| 4,806,169 | 2/1989 | Spane et al. | 134/3 |
| 4,818,298 | 4/1989 | Shishkin et al. | 134/22.11 |
| 4,872,919 | 10/1989 | Bucher et al. | 134/3 |
| 4,971,631 | 11/1990 | Salee et al. | 134/3 |
| 5,045,352 | 9/1991 | Mueller | 427/235 |
| 5,199,995 | 4/1993 | Shoji et al. | 134/2 |
| 5,322,635 | 6/1994 | Hieatt et al. | 252/82 |
| 5,360,488 | 11/1994 | Hieatt et al. | 134/22.11 |
| 5,451,335 | 9/1995 | Hieatt et al. | 252/82 |
| 5,492,629 | 2/1996 | Ludwig et al. | 210/698 |
| 5,527,395 | 6/1996 | Perry et al. | 134/3 |
| 5,680,877 | 10/1997 | Edstrand et al. | 134/103.1 |

FOREIGN PATENT DOCUMENTS

| | | |
|---|---|---|
| 2602571 | 2/1988 | France . |
| 533818 | 2/1986 | Spain . |
| 9220629 | 11/1992 | WIPO . |

*Primary Examiner*—Randy Gulakowski
*Assistant Examiner*—Saeed Chaudhry
*Attorney, Agent, or Firm*—Wood, Herron & Evans, L.L.P.

[57] ABSTRACT

A method to chemically clean and immediately passivate a water distribution system to quickly form a passivation layer. The system may be a potable water system, a non-potable water system, a water well or a fire protection system such as a fire sprinkler system and may be treated with a biocide. A section of the system is isolated and chemically cleaned, then is immediately passivated using a high concentration of passivating agent. A passivating layer quickly forms, then the concentrated passivating agent is removed and a maintenance concentration of passivating agent is added. The cleaned and passivated section is restored to the system to provide improved water flow.

18 Claims, 1 Drawing Sheet

CLEANING AND PASSIVATING WATER DISTRIBUTION SYSTEMS

FIELD OF THE INVENTION

The invention is directed to chemical method of cleaning and passivating water distribution systems, and methods of maintaining the cleaned and passivated systems.

BACKGROUND OF THE INVENTION

Improperly or incompletely maintained water distribution systems containing metal, plastic, concrete or concrete/asbestos pipe may show scale formation, sedimentation and microbiological tubercular growth by iron, manganese, sulfate-reducing, organic acid-producing, aerobic and other bacteria. This scale, sedimentation and growth may result in restricted water flow, higher pumping costs, customer complaints of the water's appearance, odor or taste, low chlorine residues, health hazards, system leakage and poor performance of the distribution systems.

Mechanical cleaning methods such as pigging, scraping, reaming and honing have been used to remove blockages from water distribution systems. These methods, however, require extensive excavation and opening of the distribution system for insertion of the appropriate tools. Valves must usually be removed and replaced along with hydrants, while elbows and hydrant connects are not usually cleaned mechanically and thus remain uncleaned. Fire protection systems such as fire sprinkler systems are impossible to clean mechanically.

Underscale corrosion causes small pits in the walls of systems which cannot be completely cleaned by mechanical methods. The residues cause immediate "red water" problems when the system is put back into service due to rust. In addition, residual bacterial growth results in new tuberculation with resulting reduced flow. Because of these residues, mechanical cleaning is normally followed by cement lining, epoxy lining, or other insertion/lining process. However, lining only covers up these residues. In addition, it decreases the diameter of the pipe and adds substantially to the rehabilitation cost.

Many of these blocked distribution systems can be cleaned by a low cost process using chemical cleaning solutions that are circulated in isolated sections of the system. One such method is disclosed in U.S. Pat. No. 5,360,488 which is assigned to the assignee of the present invention and is hereby incorporated by reference in its entirety, along with assignee's U.S. Pat. No. 5,527,395 covering a chemical cleaning process improvement, and co-pending U.S. Pat. No. 5,680,877 and U.S. patent application Ser. No. 08/675,802.

However, each distribution system's requirements for cleaning and passivating must be considered individually. Factors to consider in formulating a proper cleaning and passivating program include the source of the water, prior water treatment, water quality in terms of its pH, hardness and metal content, as well as economic factors. For example, in many chemically cleaned distribution systems the interior of the pipe is cleaned down to the bare metal, which is usually iron. Depending upon the water quality, pH, dissolved oxygen content and the like, the cleaned iron surface can form red iron oxide or hydroxide or corrosion products and may be the cause of a recurrence of red water. Specific factors, such as ensuring that treatment of potable water systems use only those corrosion and scale control agents which have been tested and certified to ANSI/NSF Standard 60, must also be considered.

In beginning a conventional potable water passivating program, a relatively higher level of passivating agent, in the range of approximately ten to thirty ppm, is added directly to water at the treatment plant. It may then take from several weeks to several months for the passivation layer to form throughout the entire distribution system. In many cases flushing is also required to establish the passivation layer, particularly in low flow or dead ends of the distribution system. Once the distribution system has been passivated, a lower concentration of passivating agent, in the range of approximately one to two ppm, must be continuously employed to maintain the passivating layer. Biocides may also be employed in water systems after cleaning.

In fire sprinkler systems different end use requirements are required due to the static nature of the water in the system which allows for microbiological growth and subsequent problems associated with the growth.

Therefore, a simple and effective method for chemically cleaning and then rapidly passivating and maintaining the chemically cleaned interior surface of various types of water distribution systems is needed.

SUMMARY OF THE INVENTION

The invention relates to a method of chemically cleaning and rapidly passivating water distribution systems, and maintaining the cleaned and passivated system. Systems that can be treated using the invention include potable water systems, non-potable water systems, water wells and fire protection systems.

In one aspect of the present invention, a section of the water distribution system is isolated and a chemical cleaning solution, preferably an aqueous solution, is added to the section. The aqueous chemical cleaning solution may be heated to a temperature in the range of about 10° C. to about 80° C. over the system water temperature before it is introduced into the section. After a sufficient time, the cleaning solution containing the solubilized, loosened or suspended scale and sediment is removed from the section. Removal may be accomplished by flushing the section with passivated water, by using air to evacuate the system, or by decanting the spent solution. Immediately, an effective concentration of passivating agent in aqueous solution is added to the section. The passivating agent may be, for example, solutions of phosphates, orthophosphates, polyphosphates, zinc compounds, silicates, carbonates, or combinations of these and may be adjusted to a pH that is optimal for the particular passivating agent selected. The passivating agent, at a concentration in the range of about 25 ppm to about 20,000 ppm, is maintained in the section for about 15 to about 120 minutes. In a preferred embodiment, the passivating solution is recirculated throughout the section, but may also be surged through the section or maintained in static contact with the section. The passivating solution is then flushed from the section with water, preferably containing a lower maintenance concentration of the same passivating agent.

Another aspect of the present invention is a method of cleaning and immediately passivating a potable water distribution system. The system is chemically cleaned and passivated as previously described but using passivating agents that have been tested and certified to ANSI/NSF Standard 60. The cleaned and passivated section is then flushed with system water containing the allowable maintenance level or less of the passivating agent. The cleaned and passivated section is then restored to the system and put back into service for providing potable water.

A further aspect of the present invention is a method of cleaning and passivating a water well. If the well is a potable water source an ANSI/NSF Standard 60 certified passivating agent is used.

A still further aspect of the present invention is a method of cleaning and maintaining a fire protection system such as a fire sprinkler system.

The above and other objects and advantages of the present invention will be made apparent from the accompanying examples and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
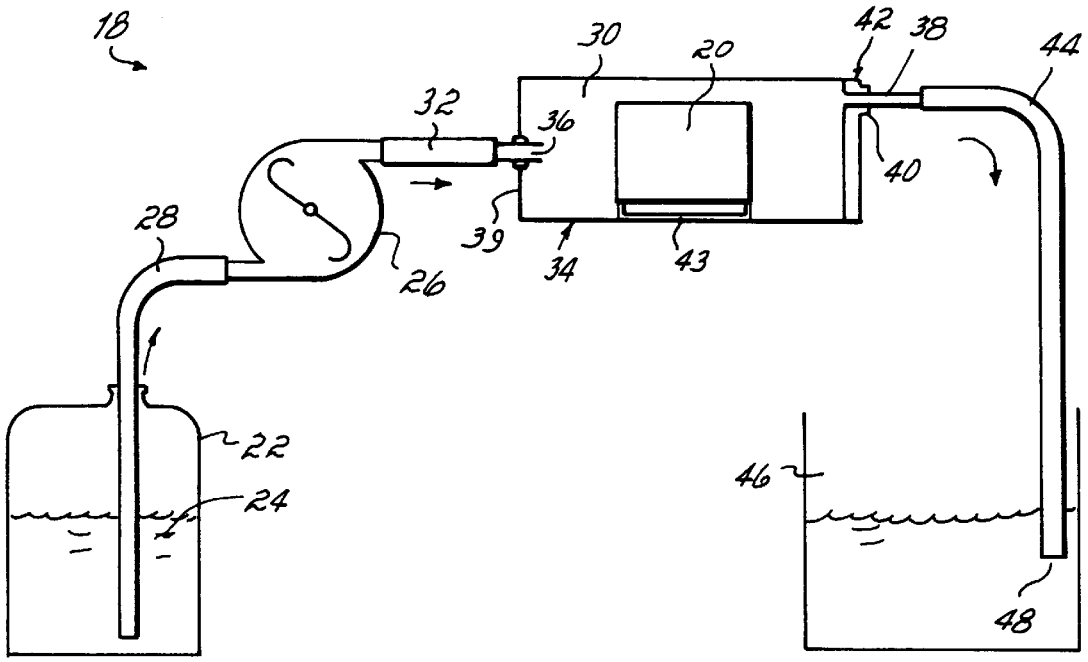
FIG. 1 is a diagram of pipe maintenance flow test equipment with the test chamber in a horizontal position.

In accordance with the invention, a section of a water distribution system having interior scale and sediment deposits is chemically cleaned and immediately and rapidly passivated. The water distribution system may be a non-potable water system, a potable water system, a water well and adjacent water-bearing formation, a fire protection system, raw water transmission lines and appurtenances, treatment process lines, finished water transmission lines and associated valves and fittings, fire sprinkler systems, hydrants, meters and pumps, customer service lines, residential, mobile, marine, commercial and industrial piping systems and irrigation systems.

An isolated section is cleaned by introducing an effective concentration of a chemical solution such as described in U.S. Pat. Nos. 5,360,488; 5,527,395; 5,492,629; 5,451,335 and 5,322,635, which are incorporated by reference herein in their entireties. The solution is preferably an aqueous solution and is circulated, surged, or maintained in static contact for a sufficient period of time to loosen or remove scale or sediment. The aqueous chemical cleaning solution may be heated to a temperature in the range of about 10° C. to about 80° C. over the system water temperature before it is introduced into the section to facilitate the reaction. After a time sufficient to loosen or remove scale or sediment, the cleaning solution containing the solubilized, loosened or suspended scale and sediment is removed from the section, or is first neutralized and then removed from the section. Removal may be accomplished by flushing the section with passivated water, by using air to evacuate the system, or by decanting the spent solution.

The cleaned section, now with improved water flow and operation, is immediately treated with an effective high concentration of a passivating agent. The passivating agent may be orthophosphates, polyphosphates, silicates, carbonates, zinc compounds or combinations of these, in an aqueous solution to establish a passivating layer on the cleaned interior surface of the system in a short period of time. Circulation of the passivating layer-forming solution is preferred; the same circulating system that was used to chemically clean the section may also be used to circulate the passivating solution. The concentration of the passivating agent is in the range of about 25 ppm to about 20,000 ppm. The passivating solution may be adjusted to a pH that is optimal for the particular passivating agent selected. If the distribution system being treated already employs a specific passivating agent, a higher concentration of the same agent is preferred to establish the passivating layer in a shorter period of time.

The passivating solution is maintained in the section for about 15 to about 120 minutes. In a preferred embodiment, the passivating solution is recirculated throughout the section, but may also be surged through the section or maintained in static contact with the section. In one embodiment a biocide, such as phenols, chlorinated phenols, hydroxybenzoic acids, benzoic acid, glutaraldehyde, formaldehyde, copper compounds, zinc compounds, chlorine, chlorine dioxide, sodium hypochlorite, calcium hypochlorite, bromine, iodine, hypobromite and quaternary ammonium compounds is added during passivation. The passivating solution is then flushed from the section with water. The water used for flushing contains the lower concentration of the same passivating agent, and is used to maintain the passivating layer in the system. The cleaned and passivated section is then restored to the system. The system is either put back into service or the remaining sections of the water distribution system are similarly treated, with each section being in passive equilibrium with the rest of the system.

In another aspect of the present invention, a potable water distribution system is cleaned and immediately passivated. The system is chemically cleaned and passivated as previously described but using passivating agents that have been tested and certified to ANSI/NSF Standard 60. Since the section to be cleaned is isolated from the rest of the system, a higher concentration of the passivating agent than the maximum allowable maintenance use level specified under ANSI/NSF Standard 60 may be employed to establish the passivation layer on the surface of the cleaned section in a short period of time. The cleaned and passivated section is then flushed with system water containing the allowable maintenance level or less of the passivating agent. In another embodiment, a biocide as previously described is added to the cleaned and passivated section. The cleaned and passivated section is then restored to the system and put back into service for providing potable water.

A further aspect of the present invention is a method of cleaning and passivating a water well. The effective amount of cleaning solution, as previously described, is introduced into the well and adjacent water-bearing formation and is maintained for a sufficient period of time to remove scale or sediment. After static, recirculating or surging treatment for a sufficient time, the solution is pumped out of, or otherwise removed from, the well and adjacent water-bearing formation. A passivating agent in aqueous solution is immediately introduced into the well at a rate that will achieve the desired concentration of passivating agent in the water in the entire well casing and pump column assembly. This rate is dependent upon the well flow rate. In one embodiment, the rate is determined such that, upon removing the cleaning solution, the concentration of passivating agent in a column of water in the well forms a passivation layer within about 15 to about 120 minutes under static conditions. The passivating agent may be added as a concentrate and may be added through a tube, such as a maintenance tube, extending from the surface to the bottom of the well. After the passivating layer has formed, preferably in a few minutes or hours under static or flow conditions, the rate of addition of passivating agent is adjusted to achieve a maintenance concentration of passivating agent. The concentrated passivating solution is then flushed from the well, discharged to waste and the well is restored to service. If the well is a potable water source an ANSI/NSF Standard 60 certified passivating agent is used.

A still further aspect of the present invention is a method of cleaning and maintaining a fire protection system such as a fire sprinkler system. A section of the system is isolated and an effective amount of a cleaning solution is introduced and circulated, surged or maintained in static contact with the system as previously described. After a time sufficient to remove scale and sediment, the solution is removed and an effective concentration of a passivating agent in aqueous solution is immediately introduced and maintained for a sufficient time to form a passivating layer on the interior of the cleaned section. The cleaned and passivated section is then restored to the system. The aqueous cleaning solution may be heated to a temperature in the range of about 10° C. to about 80° C. above system water before introducing into the system.

If the fire protection system is a sprinkler system, the sprinkler head is first removed and the system is connected via a manifold connected to a mobile recirculating unit as described in U.S. Pat. No. 5,680,877 which is incorporated by reference herein in its entirety. The solution is circulated using the mobile recirculating unit to clean the system as previously described for a water distribution system.

In a fire protection system which contains static water, such as a fire sprinkler system, passivation agents and microbiological agents (i.e. chlorine) normally supplied in the source water dissipate rapidly. If the system is supplied by a non-potable water source or if the system is supplied by a potable water source and is fitted with a back flow protector, the cleaned system can be passivated with a solution containing a high level of passivating agent and which optionally may contain a high level of a biocide. The biocide is preferably non-degradable and may be phenols, chlorinated phenols, hydroxybenzoic acid, benzoic acid, glutaraldehyde, formaldehyde, copper compounds, zinc compounds, chlorine, chlorine dioxide, sodium hypochlorite, calcium hypochlorite, bromine, iodine, hypobromite and quaternary ammonium compounds. The biocide is preferably at a concentration sufficient to maintain a biocidal inhibition in the system and may be in the range of about 10 ppm to 1% of the solution. The passivation and/or biocidal solution need not be flushed from the system but can remain in the system statically for several years to provide prolonged passivation and biocidal protection. Any water added to the fire protection system should be similarly treated with passivation and/or biocidal agents. Fire protection systems treated in this manner may be monitored for the presence of passivation and biocidal agents. Upon depletion of the agents, the system may then be replenished with a fresh passivation and/or biocidal solution to insure operational integrity of the system.

The above and other objects and advantages of the present invention will be made apparent from the accompanying examples and the description thereof.

PREPARATION OF PIPE TEST SAMPLES

An approximately two inch long section of a 2⅞" diameter iron pipe was cut from stock pipe and the sharp edges were filed or ground smooth to form a pipe test sample. The pipe test sample was washed with detergent and water to remove cuttings and oils from the surface. About six hundred ml of a 20% solution of Pipe Klean® Preblend (HERC Products Inc., Phoenix, Ariz.), an inhibited mineral acid composition with additives tested and certified to ANSI/NSF Standard 60 as a potable water pipe cleaning aid, was added to the pipe test sample. The sample was then statically cleaned of all deposits down to the bare metal. The cleaning solution was maintained in the pipe for a time sufficient to scrub, loosen, and/or suspend scale and sediment in the pipe for subsequent removal.

The chemically cleaned pipe test sample was then quickly rinsed with tap water, taking care to hold the pipe test sample by the edges so that the cleaned surface remained uncontaminated. The rinsed pipe test sample was then immediately passivated with a solution having a high concentration of the passivating agent and/or tested in the maintenance solution of the passivating agent on the pipe maintenance flow test (PMFT) equipment.

PIPE MAINTENANCE FLOW TEST (PMFT) EQUIPMENT

With reference to FIG. 1, pipe maintenance flow test equipment 18 was configured to test a chemically cleaned pipe test sample in a horizontal position (PMFT-H). For testing using the PMFT-H 20 equipment, a feed reservoir 22 having a small opening to air contained the aqueous control solution or passivating maintenance solution 24. The solution 24 was fed to a peristaltic pump 26 (Masterflex model 7016-21, Cole-Parker) via a hose 28, and was pumped to the test chamber 30 via a hose 32. The pump was chemically resistant to the solution 24 employed and pumped up to about 2500 mis/hour. The test chamber 30 was made from a 3½" diameter by 6" long clear polycarbonate wide mouth bottle 34, so that the pipe test sample 20 could be observed during the test. The test chamber 30 was fitted with an inlet hose fitting 36 and outlet hose fitting 38. The inlet hose fitting 36 was centered in the bottom 39 of the bottle 34 and the outlet hose fitting 38 was fabricated to the edge of the bottle cap 40 and positioned at the maximum height during the test in order to minimize the air pocket in the test chamber 30. The pipe test sample 20 was placed in the test chamber 30 when the test chamber 30 was in a vertical position and was filled with the aqueous test solution 24. The cap 40 was then tightened on the bottle 34 and the test chamber 30 was positioned horizontally with the outlet hose fitting 38 positioned at the top 42 of the test chamber 30. A "U" shaped plastic holder 43 was utilized to center the pipe test sample 20 in the center of the test chamber 30. This limited the contact between the pipe test sample 20 surface with the plastic holder 43 and allowed good flow of the test solution 24 over the surface of the pipe test sample 20. The test chamber 30 was then connected to the effluent hose 44 with the effluent hose 44 emptying into the effluent reservoir 46. The effluent reservoir 46 was made from a white one-gallon plastic bottle with the top removed so that the color of the aqueous test solution 24 or the presence of solids could be periodically observed in the effluent. Similar periodic observations of color, solids or surface rust on the pipe test sample 20 were made through the clear test chamber 30. Effluent water samples 48 were periodically removed from the effluent hose 44 for iron analysis. Iron analysis was performed by the 1,10 phenanthroline method as determined by the Iron Test kit, K 6010 (Chemetrics, Calverton, Va.). The aqueous solution 24 in the test chamber turned over about 2½ times per hour. The effluent reservoir 46 was emptied periodically during the test run.

Figure 2:
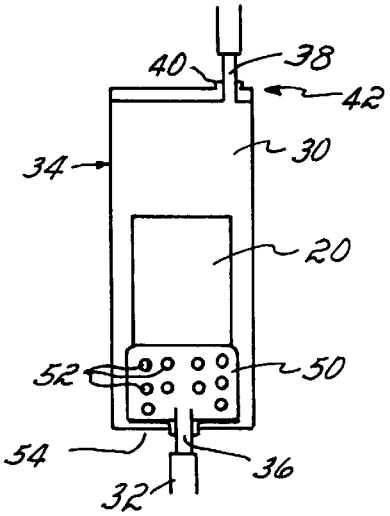
FIG. 2 is a diagram of the test chamber of FIG. 1 in a vertical position.

FIG. 2 depicts the test chamber 30 in a vertical position (PMFT-V). The pipe test sample 20 was placed on top of a plastic holder 50 to center the test pipe 20 in the test chamber 30. The plastic holder 50 had a multitude of exterior holes 52 to allow mixing of the test solution 24 entering from the bottom 54 of the test chamber 30 with the test solution 24 already in test chamber 30.

CONDITIONED TEST WATER

It was determined during the development of the pipe maintenance flow test that the results were very sensitive to the oxygen content of the test solution 24. For example, if the feed reservoir 22 was allowed to go dry and air was pumped into the test chamber 30, rust-colored water and surface rust were almost immediately observed. Dissolved oxygen in distribution system water is depleted by iron and manganese bacteria, by other bacteria, and by the formation of iron and manganese oxides and hydroxides. It was determined that if the dissolved oxygen in the test water was reduced by vigorously boiling the water and allowing it to cool overnight in sealed high-density polyethylene containers, the pipe maintenance flow test was reproducible and consistent with passivation technology.

Boiled potable tap water from the City of Phoenix, Ariz. was employed in the pipe maintenance flow test system 18 protocol. Beginning tap water tested at 10 ppm dissolved oxygen. Typical test water analysis was 2 to 3 ppm dissolved oxygen and 120 ppm total alkalinity as determined by the Indigo Carmine Method (Chemetrics Dissolved Oxygen Test Kit K-7512). The pH of the conditioned water was adjusted to the pH recommended by the supplier of the specific passivation agent employed in the pipe maintenance flow test solution.

Laboratory tests were developed to illustrate the various embodiments of the invention. The following Examples demonstrate the principles and scope of the invention and do not limit the broader aspects of the invention.

EXAMPLE 1

Effect of pH (PMFT-H)

Conditioned tap water was prepared by adjusting to pH levels of 5.2, 7.2, 7.5, 8.1, 8.6, and 9.1 with 1 N sodium hydroxide or 1 N hydrochloric acid, as required. The water was used on pipe test samples 20 using the pipe maintenance flow test 18 equipment in the horizontal position (PMFT-H). The time to first water effluent discoloration ("red water") was noted and was labeled the "failure time". Table 1 summarizes the results.

TABLE 1

| Sample | pH | Passivation | Coloration | Failure Time |
|---|---|---|---|---|
| A | 5.2 | – | Effluent & Pipe Surface | 30 min. |
| 1B | 7.2 | – | Effluent | 30 min. |
| 1C | 7.5 | – | Effluent (Fe = 0.4 ppm) | 30 min. |
| 1D | 8.1 | – | Effluent | 60 min. |
| 1E | 8.6 | – | Effluent (Fe = 0.3 ppm) | 150 min. |
| 1F | 9.1 | – | Effluent | 180 min. |

The time to effluent coloration without passivation additives was dependent on the pH of the test solution. The higher the pH, the greater the time to effluent coloration.

Suppliers of passivating agents recommend an optimum pH for their most effective utilization. The following examples employ the suppliers' recommended pH for the passivating agents tested.

EXAMPLE 2

Sodium Silicate (PMFT-H)

Conditioned tap water was prepared as a maintenance solution by adjusting to pH 8.0 and to pH 8.6 and adding 42 ppm of sodium silicate ("N" grade, PQ Corporation, Valley Forge, Pa.). A pipe test sample 20 was passivated for one hour in a passivating solution of conditioned tap water containing 1050 ppm of sodium silicate (25 times the maintenance dose) and adjusted to pH 8.6. The passivated test pipe sample 20 was rinsed with the maintenance solution at pH 8.6 and then evaluated on the pipe maintenance flow test 18 equipment. The results of the sodium silicate pipe maintenance flow test are summarized in Table 2.

TABLE 2

Sodium Silicate - 42 ppm Maintenance Concentration

| Sample | pH | Passivation | Coloration | Failure Time |
|---|---|---|---|---|
| 2A | 8.0 | – | Effluent | 30 min. |
| 2B | 8.6 | – | Effluent | 180 min. |
| 2C | 8.6 | + | None | 420 + min. |

No improvement in the control of discolored water effluent with a maintenance level of sodium silicate was observed at pH 8.0 (sample 2-A) versus conditioned water (sample 1-D) at pH 8.1. A slight improvement was observed with maintenance sodium silicate at pH 8.6 (sample 2-B) versus conditioned water alone (sample 1-E) at pH 8.6. However, when the test pipe was passivated first (sample 2-C) a major improvement was observed versus the maintenance solution alone (sample 2-B).

EXAMPLE 3

Polyphosphate (PMFT-V)

Conditioned tap water was used to prepare a maintenance passivating solution by adjusting the conditioned water to pH 7.1 and adding 15.6 ppm Calgon C-2, a polyphosphate (Calgon Corp., Pittsburgh, Pa.).

A pipe test sample 20 was passivated for one hour in a passivation solution of conditioned tap water adjusted to pH 7.1 and containing 5800 ppm of polyphosphate (370 times the maintenance dose). The pipe test sample 20 was then rinsed in the maintenance solution and evaluated on the pipe maintenance flow test 18 equipment. The results of the polyphosphate pipe maintenance flow tests are summarized in Table 3.

TABLE 3

Polyphosphate - 15.6 ppm Maintenance

| Sample | pH | Passivation | Coloration | Failure Time |
|---|---|---|---|---|
| 3A | 7.1 | – | Effluent & Pipe Surface | 120 min. |
| 3B | 7.1 | + | Effluent & Pipe Surface | 330 min. |

Effluent analysis for iron was 0.4 ppm Fe for sample 3-A after 150 min., and 0.2 ppm Fe for sample 3-B after 150 min. This further demonstrated the improvement of passivation.

There also appeared to be an improvement over the water control (sample 1-B) at pH 7.2 (failure time at 30 min.) versus just the polyphosphate maintenance (sample 3-A) (failure time at 120 min.).

EXAMPLE 4

Zinc Phosphate (PMFT-H)

Conditioned tap water was prepared as a maintenance solution by adjusting to pH 7.4 and adding 2 ppm Zn as zinc phosphate in the form of 14% zinc phosphate V-932C (Technical Products Corp., Portsmouth, Va.).

A pipe test sample 20 was passivated using conditioned tap water adjusted to pH 7.4 containing 50 ppm Zn in the form of zinc phosphate V-932C. The pipe test sample 20 was passivated for one hour and then evaluated on the pipe maintenance flow test 18 equipment. The results of the zinc phosphate pipe maintenance flow tests are summarized in Table 4.

TABLE 4

Zinc Phosphate - 2 ppm maintenance

| Sample | pH | Passivation | Coloration | Failure Time |
|---|---|---|---|---|
| 4A | 7.4 | – | Effluent (Fe = 0.3 ppm) | 30 min. |
| 4B | 7.4 | + | None (Fe = 0.1 ppm) | 420 + min. |

After 180 min. water effluent samples were assayed for iron. Sample 4-A had 0.3 ppm Fe and sample 4-B had 0.1 ppm Fe, which demonstrated that passivation at elevated levels of zinc phosphate followed by a maintenance solution of zinc phosphate substantially reduced the iron content of the effluent treatment with just a maintenance solution alone. Also, control sample 1-C had an effluent iron level of 0.4 ppm Fe after 30 min. and 0.6 ppm Fe after 60 min. This demonstrated that zinc phosphate, as a maintenance solution alone (sample 4-A) reduced the iron solubilization (red water) to some extent.

At the top of the pipe maintenance flow test 18 equipment the test chamber 30 was removed from the pipe maintenance flow test 18 equipment with the pipe test sample 20 still inside the filled test chamber 30. The filled test chamber 30 was shaken vigorously to dislodge any surface rust. Water 24 in the test chamber 30 was then observed and tested for iron. In sample 4-A, the water 24 was red and red solids were present, with an iron level of 10+ ppm Fe. In sample 4-B, the water was a light straw color, with an iron level of 3 ppm Fe. This further demonstrated the improvement obtained by passivating at elevated levels.

EXAMPLE 5

Poly/Orthophosphate Blend (PMFT-V)

Conditioned tap water was prepared as a maintenance solution by adjusting to pH 7.1 and adding 34 ppm of Calgon C-4, which is an equal blend of polyphosphates and orthophosphates (poly/orthophosphates) (Calgon Corp., Pittsburgh, Pa.). A rinsed pipe test sample 20 was passivated in a passivating solution of conditioned tap water containing 12,000 ppm of Calgon C-4 for one hour. The passivated test pipe sample 20 was rinsed in the maintenance solution and then evaluated using the pipe maintenance flow test 18 equipment. The results of the poly/orthophosphate pipe maintenance flow test, with the test chamber in the vertical position, are summarized in Table 5.

TABLE 5

Poly/Orthophosphate - 34 ppm Maintenance Concentration

| Sample | pH | Passivation | Coloration | Failure Time |
|---|---|---|---|---|
| 5A | 7.1 | – | None in effluent Rust in test chamber only | 150 min. |

TABLE 5-continued

Poly/Orthophosphate - 34 ppm Maintenance Concentration

| Sample | pH | Passivation | Coloration | Failure Time |
|---|---|---|---|---|
| 5B | 7.1 | + | None in effluent Rust in test chamber only | 240 min. |

It was of interest to note that no discoloration of the effluent was observed. This indicated that the iron present was "tied up" with the poly/orthophosphates. After 90 min. the iron content in effluent water was 0.9 ppm Fe in sample 5-A and 0.3 ppm Fe in sample 5-B, indicating that passivation had occurred. After 240 min. both samples 5-A and 5-B effluents had an iron content of 0.3 ppm Fe. This indicated that passivation had occurred with the maintenance solution over an extended period of time.

EXAMPLE 6

Zinc Polyphosphate Blend (PMFT-V)

Conditioned tap water was prepared as a maintenance solution by adjusting to pH 7.1 and adding 14 ppm of Calgon C-39 (solid) (Calgon Corp, Pittsburgh, Pa.) in the form of a stock solution. A rinsed pipe test sample 20 was passivated in a passivating solution of conditioned tap water containing 1400 ppm of Calgon C-39 in solution at pH 7.1 for one hour. The passivated pipe sample 20 was then rinsed in the maintenance solution and evaluated on the pipe maintenance flow test 18 equipment. The results of the zinc polyphosphate blend pipe maintenance flow test are summarized in Table 6.

TABLE 6

Zinc Polyphosphate - 14 ppm Maintenance Concentration

| Sample | pH | Passivation | Coloration | Failure Time |
|---|---|---|---|---|
| 6A | 7.1 | – | Effluent | 90 min. |
| 6B | 7.1 | + | Effluent | 150 min. |

After 90 min. sample 6-A effluent had an iron content of 0.6 ppm Fe and sample 6-B effluent had an iron content of 0.3 ppm Fe, indicating that passivation had occurred. The test continued for 270 min., after which sample 6-A effluent was a light straw color and had an iron content of 0.6 ppm Fe. Sample 6-B effluent was only slightly straw colored and had an iron content of 0.4 ppm Fe.

The test chambers 30 were then disconnected from the pipe maintenance flow test equipment and shaken vigorously to loosen surface rust. Water 24 from the sample 6-A test chamber 30 became straw colored with red solids and had an iron content of 8 ppm Fe. Water from the sample 6-B test chamber was only slightly straw colored, showed no red solids and had an iron content of 2 ppm Fe. This further demonstrated the improvement of passivation.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described.

Accordingly, departures may be made from such details without departing from the spirit or scope of applicant's general inventive concept.

What is claimed is:

1. A method of cleaning and passivating a water pipe distribution system, comprising:

isolating a pipe section of the system for introducing a cleaning solution through an interior of the section;

introducing an effective amount of the cleaning solution into the section;

maintaining the cleaning solution in the section to remove scale and sediment from the interior of the section;

removing the cleaning solution containing the scale and sediment from the section to provide a cleaned interior section;

immediately introducing into the cleaned interior section an effective concentration of a passivating agent in aqueous solution;

maintaining the effective concentration of passivating agent in the cleaned section for about 15 to about 120 minutes to form a passivating layer on the interior of the cleaned section; and restoring the cleaned and passivated section with the system.

2. The method of claim 1 further comprising adding a biocide to the cleaned interior section.

3. The method of claim 2 wherein the biocide is added during passivation.

4. The method of claim 2 wherein the biocide is added to the cleaned and passivated section.

5. The method of claim 1 wherein the cleaning solution is aqueous.

6. The method of claim 5 wherein aqueous cleaning solution is heated to and maintained at a temperature in the range of about 10° C. to about 80° C. over system water temperature before introducing into the system.

7. The method of claim 1 wherein the cleaning solution is removed by flushing the section with passivating water.

8. The method of claim 1 wherein the cleaning solution is removed by evacuating the section with air.

9. The method of claim 1 wherein the cleaning solution is removed by decanting.

10. The method of claim 1 wherein the passivating agent is selected from the group consisting of phosphates, orthophosphates, polyphosphates, zinc compounds, silicates, carbonates and combinations thereof.

11. The method of claim 1 wherein the effective concentration of passivating agent is in the range of about 25 ppm to about 20,000 ppm.

12. The method of claim 1 wherein the passivating solution is recirculated through the section.

13. The method of claim 1 wherein the passivating solution is in static contact with the section.

14. The method of claim 1 wherein the passivating solution is surged through the section.

15. The method of claim 1 further comprising adjusting a pH of the aqueous passivating solution to the pH optimal for the passivating agent.

16. The method of claim 1 wherein the water for removing the effective amount of passivating solution contains the maintenance concentration of the passivating agent.

17. The method of claim 1 wherein the system is selected from the group consisting of water wells, raw water transmission lines and appurtenances, treatment process lines, finished water transmission lines and associated valves and fittings, fire protection systems, fire sprinkler systems, hydrants, meters and pumps, customer service lines, residential, mobile, marine, commercial and industrial piping systems and irrigation systems.

18. The method of claim 1 wherein the system is a potable water distribution system and the cleaning and passivating chemicals are certified to ANSI/NSF Standard 60.

* * * * *

UNITED STATES PATENT AND TRADEMARK OFFICE

CERTIFICATE OF CORRECTION

PATENT NO. : 6,076,536
DATED : June 20, 2000
INVENTOR(S) : Jerome H. Ludwig et al.

It is certified that error appears in the above-identified patent and that said Letters Patent is hereby corrected as shown below:

Column 6,
Line 21, "sample in" should be -- sample 20 in --
Line 29, "mis/hour" should be -- mls/hour --

Column 8,
Line 15, "30 min." should be -- 60 min. --

Signed and Sealed this

Twenty-Seventh Day of November, 2001

*Attest:*

Nicholas P. Godici

*Attesting Officer*

NICHOLAS P. GODICI
*Acting Director of the United States Patent and Trademark Office*